US005154103A

United States Patent [19]

Lewis, Jr.

[11] Patent Number: 5,154,103

[45] Date of Patent: Oct. 13, 1992

[54] LOCK FOR ADJUSTABLE WRENCH

[76] Inventor: Barney E. Lewis, Jr., Rte. 2, Box 221-Z, Laurel Hill, N.C. 28351

[21] Appl. No.: 687,008

[22] Filed: Apr. 18, 1991

[51] Int. Cl.[5] ..... B25B 13/16

[52] U.S. Cl. ..... 81/165; 81/170; 81/DIG. 3

[58] Field of Search ..... 81/165, 170, DIG. 3

[56] References Cited

U.S. PATENT DOCUMENTS

| | | | |
|---|---|---|---|
| 1,512,846 | 10/1924 | Gumprecht | 81/165 |
| 1,599,162 | 9/1926 | Brown | 81/165 |
| 2,506,066 | 5/1950 | Coates | 81/165 |
| 2,780,124 | 2/1957 | Lyons | 81/165 |

FOREIGN PATENT DOCUMENTS

| | | | |
|---|---|---|---|
| 1064587 | 12/1953 | France | 81/165 |
| 158944 | 3/1957 | Sweden | 81/165 |

*Primary Examiner*—James G. Smith

*Attorney, Agent, or Firm*—Fleit, Jacobson, Cohn, Price, Holman & Stern

[57] ABSTRACT

A lock for an adjustable wrench to lock the adjustable jaw of the wrench in adjusted position. The lock includes a slide mounted on the wrench handle adjacent the head of the wrench for longitudinal slidable and guided movement with a thumb receiving member at the end of the slide remote from the wrench head and an arcuately curved recess on the inner surface of the slide engaging with the rotatable worm wheel used to adjust the adjustable jaw of the wrench thereby retaining the worm wheel and adjustable jaw in adjusted position by frictional engagement between the slide and worm wheel. The slide includes a longitudinal slot receiving a pin which slidably anchors the slide to the wrench handle adjacent the wrench head with the end of the slide remote from the wrench head including a depending tapering projection to engage and be guided by longitudinal edge ridges or flanges normally provided on the handle of an adjustable wrench thereby maintaining the slide in longitudinal alignment with the wrench handle for movement toward and away from the rotatable worm wheel used to adjust the adjustable jaw of the wrench.

5 Claims, 1 Drawing Sheet

LOCK FOR ADJUSTABLE WRENCH

BACKGROUND OF THE INVENTION

1. Field of the Invention

The present invention generally relates to improvements in adjustable wrenches and more specifically a lock for an adjustable wrench to lock the adjustable jaw of the wrench in adjusted position. The lock includes a slide mounted on the wrench handl adjacent the head of the wrench for longitudinal slidable and guided movement with a thumb receiving member at the end of the slide remote from the wrench head and an arcuately curved recess on the inner surface of the slide engaging with the rotatable worm wheel used to adjust the adjustable jaw of the wrench thereby retaining the worm wheel and adjustable jaw in adjusted position by frictional engagement between the slide and worm wheel. The slide includes a longitudinal slot receiving a pin which slidably anchors the slide to the wrench handle adjacent the wrench head with the end of the slide remote from the wrench head including a depending tapering projection to engage and be guided by longitudinal edge ridges or flanges normally provided on the handle of an adjustable wrench thereby maintaining the slide in longitudinal alignment with the wrench handle for movement toward and away from the rotatable worm wheel used to adjust the adjustable jaw of the wrench.

2. Description of the Prior Art

Adjustable wrenches of various types are known and on the market. One of the most popular adjustable wrenches being marketed is a crescent wrench which includes an adjustable jaw having a rack gear thereon which is engaged by a rotatable worm gear which has a peripheral rib provided with serrations which are exposed to opposite sides of the wrench head to enable the worm wheel to be rotated for adjusting the adjustable jaw. When using the wrench, the adjustable jaw frequently moves from its adjusted position which can cause the wrench to slip off of the nut or bolt head with which it is engaged. This frequently results in injury due to rapid acceleration of the wrench handle when the wrench releases from the nut or bolt head with the knuckles of the hand gripping the wrench handle sometimes coming into contact with stationary objects resulting in injury to the knuckles. This phenomena is generally referred to as "knuckle busting" and adjustable end wrenches are well known for their "knuckle busting" characteristics. In view of this ongoing problem, efforts have been made to prevent accidental rotation of the worm wheel which results in maladjustment of the adjustable jaw. The following U.S. patent relate to efforts to solve the problem of the adjustable jaw of an adjustable wrench moving during normal use of the wrench.

1,321,777
1,749,002
2,309,529
2,780,124
4.548,104

None of the above patents disclose the specific novel features of the lock for an adjustable wrench incorporated into this invention.

SUMMARY OF THE INVENTION

An object of the present invention is to provide a lock for an adjustable wrench that includes a slide mounted on the wrench handle for longitudinal movement toward and away from the wrench head with the slide including a uniquely constructed end portion which frictionally engages the external surface of the spiral rib or gear tooth on the worm wheel used for moving the adjustable jaw of the wrench to frictionally lock the worm wheel in adjusted position to prevent the worm wheel from turning and the adjustable jaw from moving during normal use of the wrench.

Another object of the invention is to provide a lock for an adjustable wrench which can be incorporated into existing wrenches as a retrofit device and also incorporated into new wrenches when they are manufactured with the lock device being relatively inexpensive but yet dependable, reliable and longlasting with installation of the lock requiring minimal modification of conventional wrench structure.

A further object of the invention is to provide a lock for an adjustable wrench as set forth in the preceding objects in which the slide may be constructed of various materials and the retaining pin ma also be constructed of various materials with the slide including an arcuate recess in the inner surface thereof to engage the worm wheel with the engagement of the slide with the worm wheel causing it to turn slightly for a better and more snug fit with respect to the nut or bolt head with which it is engaged with the slide placing pressure on the side of the wheel to prevent it from rotating rather than including structure which extends into the spiral groove or spiral notch in the worm wheel which frequently becomes battered, filled with dirt and oil residue which renders other devices insecure.

Still another object of the invention is to provide a lock for adjustable wrenches as set forth in the preceding objects in which the slide includes an outwardly projecting thumb engaging member defined by outwardly converging flat surfaces to facilitate engagement by the thumb of the hand gripping the wrench handle with the slide also including an inward projection with converging flat opposed surfaces for sliding and guiding engagement with the ribs or flanges normally provided along the side edges of the handle thereby retaining the slide in longitudinal alignment with the wrench handle.

These together with other objects and advantages which will become subsequently apparent reside in the details of construction and operation as more fully hereinafter described and claimed reference being had to the accompanying drawings forming a part hereof, wherein like numerals refer to like parts throughout.

DESCRIPTION OF THE PREFERRED EMBODIMENT

Figure 1:
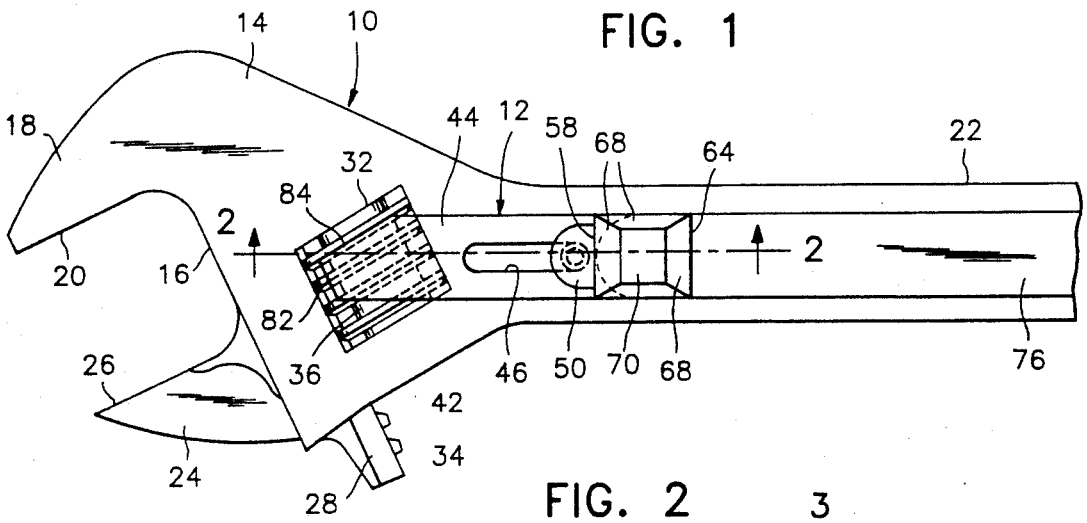
FIG. 1 is a plan view of a portion of an adjustable wrench illustrating the lock of the present invention mounted on the wrench.
Figure 2:
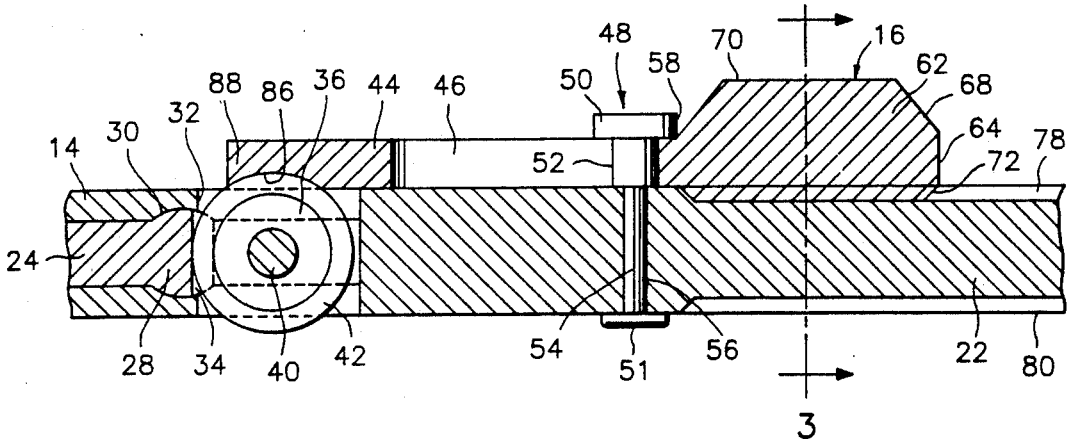
FIG. 2 is a longitudinal, sectional view, on an enlarged scale taken substantially along section line 2—2 on FIG. 1 illustrating further structural details of the lock of the present invention and its association with the wrench handle and worm wheel.
Figure 3:
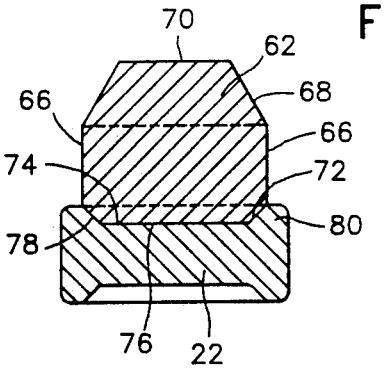
FIG. 3 is a transverse, sectional view taken substantially upon a plane passing along section line 3—3 on FIG. 2 illustrating the structural details of the thumb engaging member and the association of the inwardly projection guide surfaces which engage the flanges on the edges of the wrench handle.

Referring now specifically to FIG. 1, an adjustable wrench is generally designated by reference numeral 10 with the lock of the present invention mounted thereon and generally being designated by reference numeral 12. The wrench 10 is of conventional configuration and includes a wrench head 14 defined by generally flat opposed surfaces and an end edge 16 provided with a projecting stationary jaw 18 integral therewith with the jaw 18 including a jaw surface 20 generally in perpendicular relation to the end edge 16 which is inclined in relation to an elongated wrench handle 22 which is unitary with the wrench head 14 and provides a handle by which the wrench can be manipulated in a conventional manner. The wrench head 14 also includes a movable, adjustable jaw 24 having a jaw surface 26 generally parallel to the jaw surface 20 and perpendicular to the end edge 16 with the jaw 24 being adjusted towards and away from the jaw 18. The movable jaw includes an elongated member 28 which is enlarged cross-sectionally and guided by a recess 30 in the wrench head 14 as illustrated in FIG. 2 as is conventional with the wrench head 14 including a passageway therethrough designated by reference numeral 32. The member 28 moves in the guide 30 with the inner most edge thereof exposed in the passageway 32. The inner edge of the member 28 includes a plurality of spaced gear teeth 34 thereon which also move in relation to the passageway 32 through the wrench head 14. Rotatably mounted in the passageway 32 is a worm wheel 36 mounted on a shaft 40 with the worm wheel including a spiral rib or gear tooth 42 thereon in meshing engagement with the gear teeth 34 so that rotation of the worm wheel 36 will cause the jaw 24 to move towards and away from the jaw 18. All of this represents conventional adjustable end wrench structure.

The lock 12 of the present invention includes an elongated generally rectangular slide 44 positioned against the portion of the wrench head 14 where it merges with the handle 22 with the slide 44 including an elongated longitudinal slot 46 in the central portion thereof to receive a retaining pin generally designated by reference numeral 48 to slidably secure the slide 44 to the wrench handle at its juncture with the wrench head. The pin 48 includes a head 50, a large diameter shank portion 52 and a smaller diameter shank portion 54 which extends through a transverse hole 56 in the wrench handle. The larger diameter portion 52 of the pin 48 is received in the slot 46 with the diameter of the larger portion 52 being closely received in the slot 46. The head 50 is generally circular in configuration but includes a flat edge portion 58 which engages a thumb engaging member generally designated by reference numeral 60 on on end of the slide 44.

Figure 4:
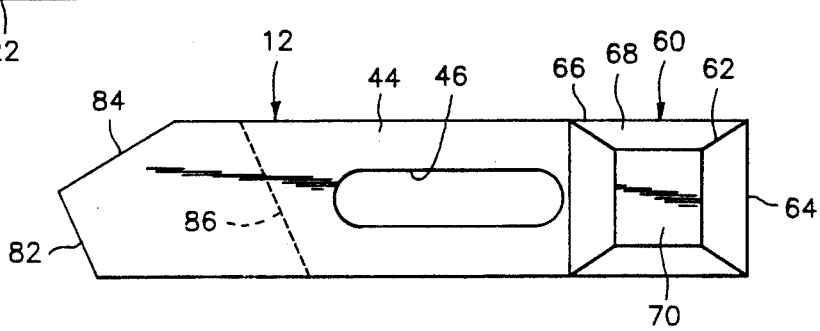
FIG. 4 is a top plan view of the slide.

The thumb engaging member 60 includes a thickened body portion 62 of square o rectangular configuration and provided with vertical end and side edges 64 and 66 which form continuations of the slide with the end and side edge 64 and 66 including vertical portions and upwardly converging flat surface portions 68 terminating in a top flat surface 70 as illustrated in FIG. 4. The flat edge 58 on the head 50 will engage the inclined surface 68 on the slide 44 disposed adjacent one end of the slot 46 to enable the end of the slot 46 to contact the larger diameter portion 52 of the pin 48 as illustrated in FIG. 2.

The inner edges of the end wall 64 and side edges 66 extend downwardly as flat end and side edges 72 which terminate in a flat inner surface 74 with these surfaces engaging the surface 76 of the handle 22 with the inclined side edges 72 engaging the inclined inwardly facing surfaces 78 on edge flanges 80 on the handle 22. The edge flanges 80 on the handle 22 are conventionally provided on wrench handles for an adjustable wrench with the pin 48 retaining the slide on the wrench with the inclined side edges 72 and the flat inner surface 74 engaging and being guided by the flanges 80 thus guiding the movement of the slide 44 and retaining it in longitudinal alignment with the handle 22 for movement toward and away from the passageway 32 which extends through the wrench head 14.

The end of the slide remote from the thumb engaging member includes angled edge portions 82 and 84 with the angle edge portion 82 generally paralleling the inclined side edges of the passageway 32 and generally paralleling the axis of rotation of the worm wheel 42 with the surface 84 generally being perpendicular to the surface 82 as illustrated in FIG. 1 thereby eliminating an upper corner on the slide in FIG. 1 which would tend to interfere with operation of the slide since it would engage the top edge of the passageway 32.

The inner surface of the slide is provided with a transversely extending inclined arcuate recess 86 which has a center paralleling the angled end 82 and which will frictionally engage the peripheral surface of the worm wheel 36 when the slide is moved toward the wrench head with the movement of the slide being guided and controlled by the pin 48 extending through the slot 46 and the thumb engaging member 60 including the inclined surfaces 72 engaging the surface 76 on the wrench handle 22 and the surface 78 o the flanges 80 on the wrench handle 22.

As illustrated in FIGS. 1 and 2, the arcuate recess 86 has a cylindrical curvature similar to the cylindrical curvature of the outer serrated or knurled edges of the spiral rib or gear tooth 42 on the worm wheel 36. The slide is constructed of plastic or other material having a degree of resiliency which enables the arcuate recess 86 to engage the worm wheel when it is slid toward locking position. The outer tip end of the recess 86 as designated by reference numeral 88 will contact the periphery of the worm wheel 36 when the slide is moving toward the worm wheel thus causing a very slight rotation of the worm wheel as it rides up over the worm wheel to provide a more secure tightening or adjustment of the wrench on a nut or bolt head and the recess 86 will frictionally engage the worm wheel by engaging a substantially longitudinally straight and arcuate partial cylindrical surface with the periphery of the worm wheel thus providing lateral frictional looking engagement with the worm wheel to enable the wrench to be used in a conventional manner without the adjustable jaw moving in re ation to the stationary jaw. When the slide is moved back to its original unlocked position, the tip end of the arcuate recess will also tend to loosen the worm wheel slightly to facilitate the jaws becoming disconnected from the nut or bolt head with which it was engaged.

The slide and retaining pin may be constructed of various plastic materials including nylon or may be constructed of metallic material with the pin being anchored in place by the end thereof remote from the head 50 being riveted as at 51 or any other means may be provided to secure the mounting pin in place in the wrench.

The lock of the present invention provides a relatively simple attachment to an adjustable wrench which will effectively lock the wrench in adjusted condition in a reliable manner since it does not rely upon the conditions of the spiral rib or gear on the worm wheel which frequently becomes damaged or irregular due to contact with various surfaces during use and frequently becomes clogged with dirt, oil residue and the like which renders locking devices which are inserted into the channel or groove ineffective or unreliable.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scop of the invention.

What is claimed as new is as follows:

1. A lock for an adjustable wrench having an elongated wrench handle, a wrench head including a stationary jaw, a movable jaw and a rotatable worm wheel to adjust the movable jaw, said worm wheel including an outer periphery engaged by the thumb and fingers to enable rotation of the worm wheel to adjust the movable jaw, said lock comprising an elongated slide, means slidably and guidingly mounting the slide on the wrench handle, one end of the slide including an inner surface frictionally engaging the outer periphery of said rotatable worm wheel in the wrench head to frictionally prevent rotation of the worm wheel to releasably lock the movable jaw of the adjustable wrench in adjusted position, said slide including an arcuate recess on said inner surface thereof, said recess including a longitudinal axis parallel to a rotational axis of the worm wheel thereby enabling the arcuate recess to engage a substantial portion of the outer periphery of the worm wheel and a substantial length of the worm wheel, said arcuate recess having a tip end portion which rides over the outer periphery of the worm wheel when engaging the slide with the worm wheel and disengaging the slide from the worm wheel to provide a final adjustment of the worm wheel when the slide is moved between locking and unlocking positions.

2. The structure as defined in claim 1 wherein said slide includes a longitudinal slot, a pin extending through the slot and mounted on the wrench handle for slidably retaining the slide on the wrench handle.

3. The structure as defined in claim 2 wherein said inner surface of the slide remote from the worm wheel includes an inner projection having inclined edges adapted to engage edge flanges on the wrench handle to guide longitudinal sliding movement of the slide.

4. The structure as defined in claim 3 wherein an end of the slide remote from the worm wheel includes an upward projection having a flat inclined surface forming a thumb engaging member on the slide to facilitate longitudinal movement of the slide.

5. A lock for an adjustable wrench which includes an elongated rigid wrench handle having a wrench head at one end, said wrench head including a stationary jaw and a movable jaw, said wrench head also including a cavity therein receiving a rotatable worm wheel engaged with the movable jaw to move the movable jaw in relation to the stationary jaw, said worm wheel having an outer periphery which projects slightly outwardly from said cavity to enable rotational manipulation thereof by the thumb and fingers for adjusting the movable jaw, said lock comprising an elongated slide, means mounting the slide on the wrench handle for longitudinal movement of the slide in relation to the wrench handle and wrench head, said slide including means engaging the outer periphery of the worm wheel at one end thereof and a thumbh engaging member at the other end thereof for moving the slide between a position engaging and frictionally locking the worm wheel to a position disengaged from the worm wheel, said slide including an inner surface engaged with the wrench handle, said inner surface including a concave recess extending from said one end of the slide toward the other end, said recess engaging the outer periphery of the worm wheel when the slide is moved toward the wrench head with the recess in the inner surface of the slide moving laterally across said cavity and engaging a portion of the outer periphery of the worm wheel which extends laterally from said cavity, said recess being of arcuate configuration generally conforming with the outer periphery of said worm wheel with the recess having a tip end which engages and rides over the outer periphery of the worm wheel when the slide is moved toward and away from the wrench head.

* * * * *